United States Patent [19]

O'Neal et al.

[11] 4,429,911

[45] Feb. 7, 1984

[54] SECURITY DOOR BAR SYSTEM

[76] Inventors: William C. O'Neal, 4903 E. Crestwood, Little Rock, Ark. 72209; James L. Grasby, 659 Cloverdale Rd., Jacksonville, Ark. 72076

[21] Appl. No.: 353,574

[22] Filed: Mar. 1, 1982

[51] Int. Cl.[3] ..... E05C 19/18; E05C 17/06

[52] U.S. Cl. ..... 292/259 R; 292/244; 292/272

[58] Field of Search ..... 292/259, 268, 272, 244, 292/288, 289, 339

[56] References Cited

U.S. PATENT DOCUMENTS

| | | | |
|---|---|---|---|
| 1,722,736 | 7/1929 | Derbyshire | 292/268 |
| 3,167,840 | 2/1965 | Hoffman | 292/244 X |
| 3,806,179 | 4/1974 | Roessle | 292/259 |
| 3,971,582 | 7/1976 | Walker | 292/259 R X |
| 4,017,104 | 4/1977 | Walker | 292/259 R X |
| 4,082,332 | 4/1978 | Palmer | 292/259 R |
| 4,119,336 | 10/1978 | Sparrevohn | 292/268 |
| 4,335,910 | 6/1982 | Massie | 292/259 R |

FOREIGN PATENT DOCUMENTS

| | | | |
|---|---|---|---|
| 2952260 | 7/1980 | Fed. Rep. of Germany | 292/268 |

*Primary Examiner*—Gary L. Smith
*Assistant Examiner*—R. Illich
*Attorney, Agent, or Firm*—Stephen D. Carver

[57] ABSTRACT

A security bar system for physically preventing unwanted opening of a door. The system preferably comprises an elongated, rigid, generally cylindrical bar which is adapted to extend in front of the door between a pair of mounting brackets. The door bar terminates at its opposite ends in flange members which are separated from the major length of the bar by reduced diameter segments of predetermined length. The door bar is adapted to axially penetrate, and be restrained by and between, the bracket members. Each bracket member includes a symmetrical slot geometry whereby to permit mounting of the system in either a right or left sided application. A first mounting bracket includes an elongated slot, the center of which is provided with a clearance hole to axially receive one bar flange. The reduced diameter segment of the door bar tracks within the extremities of the slot. The opposite door bracket includes a generally T-shaped slot, the intersection of horizontal and vertical portions of the slot admitting the opposite door bar flange. Similarly, the reduced diameter segment of the door bar tracks within the slots, and tracking within the horizontal slot permits the door to be opened a predetermined amount without sacrificing security integrity.

1 Claim, 9 Drawing Figures

FIG.3
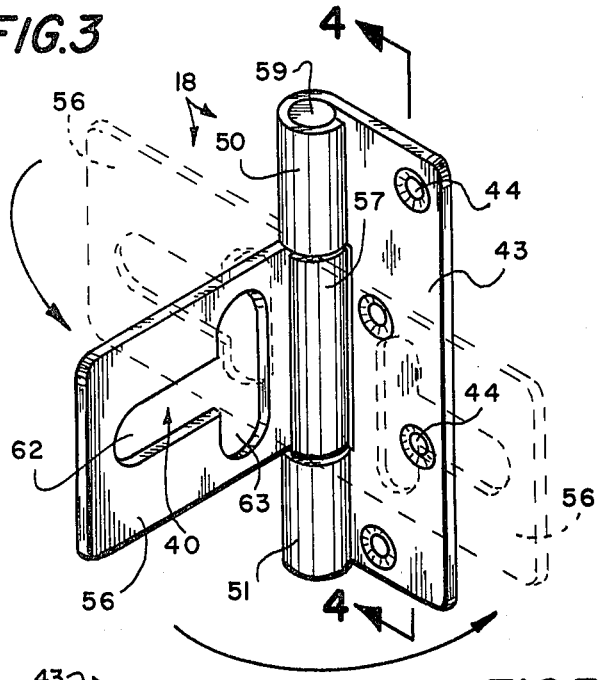
FIG.6
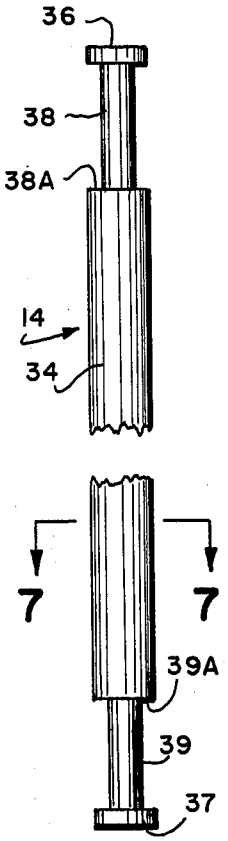
FIG.7
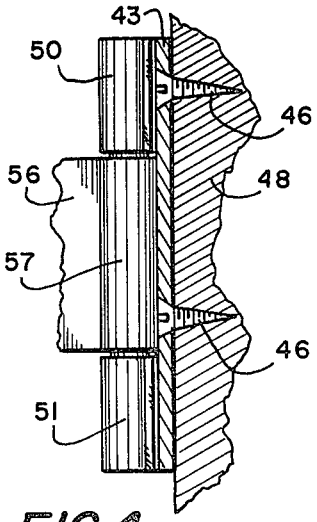
FIG.4
FIG.5
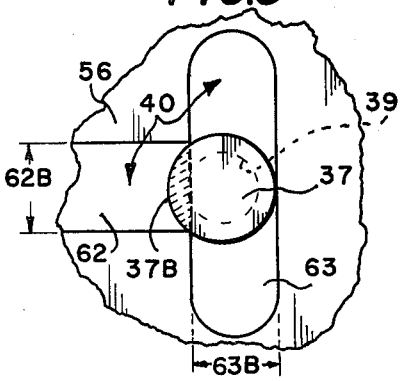
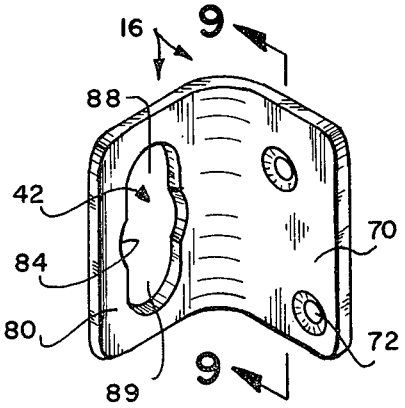
FIG.8
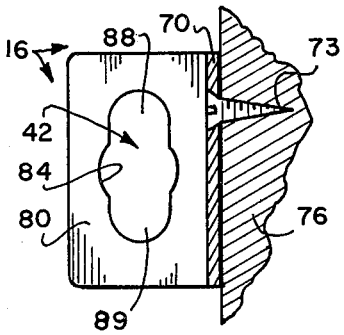
FIG.9

SECURITY DOOR BAR SYSTEM

BACKGROUND OF THE INVENTION

The present invention relates generally to hardware and apparatus for securing conventional doors or the like. More particularly, the present invention is related to a door bar system adapted to be removably, securely mounted between opposite sides of a door to prevent it from being opened. It is believed that U.S. Class 292, Subclass 268 is most relevant.

In the prior art a variety of systems have been employed to mount door bars or braces for security reasons. With the increasing nationwide crime rate the need for security devices is readily apparent. In the prior art a variety of door bar systems have been proposed. Most of these suffer from the disadvantage that at least one end of the door bar comtemplated must be permanently coupled to one side of the door to be blocked. Since the apparatus cannot be easily removed, it may sometimes present an aesthetic objection. Moreover, such systems tend to constantly "get in the way" and they may interfere with desired ingress and egress. Because of the structure of known prior art devices many cannot be mounted in "right sided" or left sided" operation. For example, doors may be hinged on the left or on the right, and the associated conventional door knob, door latch or the like will be located upon the opposite side. Since applications vary in this manner, a viable commercial door bar system must be able to quickly and easily adapt for mounting on either left sided or right sided applications.

Examples of prior art door latch or door bar security systems in which a portion of the door bar is securely and permanently mounted adjacent the door may be seen in the following U.S. Pat. Nos.: 4,017,104; 3,986,741; 4,067,598; and 3,955,844. U.S. Pat. Nos. 4,119,336 and 3,971,582 include door latching assemblies in which some form of slotted locking member is provided. U.S. Pat. No. 4,082,332 provides a door bar system in which the bar may be axially removed from one bracket, while vertical displacement to an opposite side of the bar will quickly result in discharge of the bar from its intended operation.

SUMMARY OF THE INVENTION

The present invention comprises a security door bar system for preventing undesired, forcible entry of a door. The system is adapted to facilitate limited opening of the door, while firmly restraining the door from further unwanted displacement. Thus security is nevertheless maintained when the occupant of the premises opens the door to talk to or view one seeking entry.

To this effect the system contemplates an elongated, rigid, generally cylindrical bar adapted to extend across and block a door. The bar terminates at its opposite ends in a pair of flanges, which are separated from the major length of the bar by reduced diameter segments of predetermined length. The bar is adapted to be received at opposite sides of the door within suitable brackets to which the bar may be axially attached, and from which the bar may be axially withdrawn when desired.

A first mounting bracket includes an elongated, interior slot adapted to be vertically oriented with respect to ground. A central orifice defined in the slot is of sufficient diameter to admit one of the bar flange ends, while the diameter of the major portion of the slot is sufficient merely to permit clearance of the door bar reduced diameter segment. Thus, once the door end is inserted through the orifice, the reduced diameter segment will drop within the slot and axial displacement of the bar in either direction will be prevented.

The opposite mounting bracket includes a generally planar member adapted to be rigidly coupled adjacent the door. A cooperating, offset portion secured to the mounting portion includes a generally T-shaped slot comprised of intersecting vertically and horizontally extending portions. The intersection of these two slot segments permits axial penetration by an opposite bar flange end, and once the flange penetrates the bracket, the reduced diameter segment may trackingly fall within the vertical slot to thus latch the door. However, when it is desired to open the door a predetermined amount while maintaining complete security, the reduced diameter segment may track within the horizontal portion of the T-shaped slot, thus permitting limited opening of the door. Since the slot is of generally T-shaped configuration, it will work along the lines discussed equally well in either a left sided or right sided mounting environment. In fact, the entire door bar security system is symmetrical, and it may be used for both left handed and right handed applications simply by appropriately configuring its constituent elements.

Thus an object of the present invention is to provide a door bar system for maximizing the security of a dwelling or other enclosure.

A related object is to provide a security enhancement system which may be installed at minimum cost.

Yet another object of the present invention is to provide a security system of the character described which will allow easy consumer installation without extensive modification to existing structure.

A still further object of the present invention is to provide a door bar security system of the character described which may be used in conjunction with either right sided or left sided applications. In other words, because of the symmetry of the parts involved, the door bar described may be employed equally advantageously in conjunction with doors which open from the left or from the right.

Yet another object is to provide a door bar assembly which may be quickly and easily removed from use when desired without unfastening complex hinge assemblies or the like.

Another important object of the present invention is to provide a door bar security system of the character described which will maintain security while permitting the door to be partially opened.

Thus it is an object of the present invention to provide a system whereby the occupant of the dwelling may partially open the door while maintaining his security.

It is a similar object of the present invention to avoid the use of bar hinge or bar pin assemblies which often are rigidly, permanently coupled to opposite sides of the door in prior art designs.

Yet another object of the present invention is to provide a door bar security system of the character described which will only minimally disturb the aesthetics of the dwelling (or other enclosure) to be protected.

A still further object of the present invention is to provide a door bar security system of the character described which cannot be dislodged from its mounting clamps without being axially maneuvered by the occupant of the protected dwelling.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification, and which are to be construed in conjunction therewith, and in which like reference numerals have been employed throughout to indicate like parts in the various views:

FIG. 3 is an enlarged, isometric view of the displacement mounting bracket preferably employed in conjunction with the present invention, with moved positions indicated in dashed lines;

FIG. 4 is a sectional view taken generally along line 4—4 of FIG. 3, with parts thereof broken away for brevity;

FIG. 5 is a fragmentary, elevational view of the offset portion of the displacement bracket, indicating the flange penetration region of the T-shaped slot;

FIG. 6 is a fragmentary; elevational view of the preferred door bar;

FIG. 7 is a sectional view taken generally along line 7—7 of FIG. 6;

FIG. 8 is an enlarged, isometric view of the first mounting bracket preferably employed in conjunction with present invention; and, FIG. 9 is a fragmentary sectional view taken generally slong line 9—9 of FIG. 8.

DETAILED DESCRIPTION OF THE INVENTION

Figure 1:
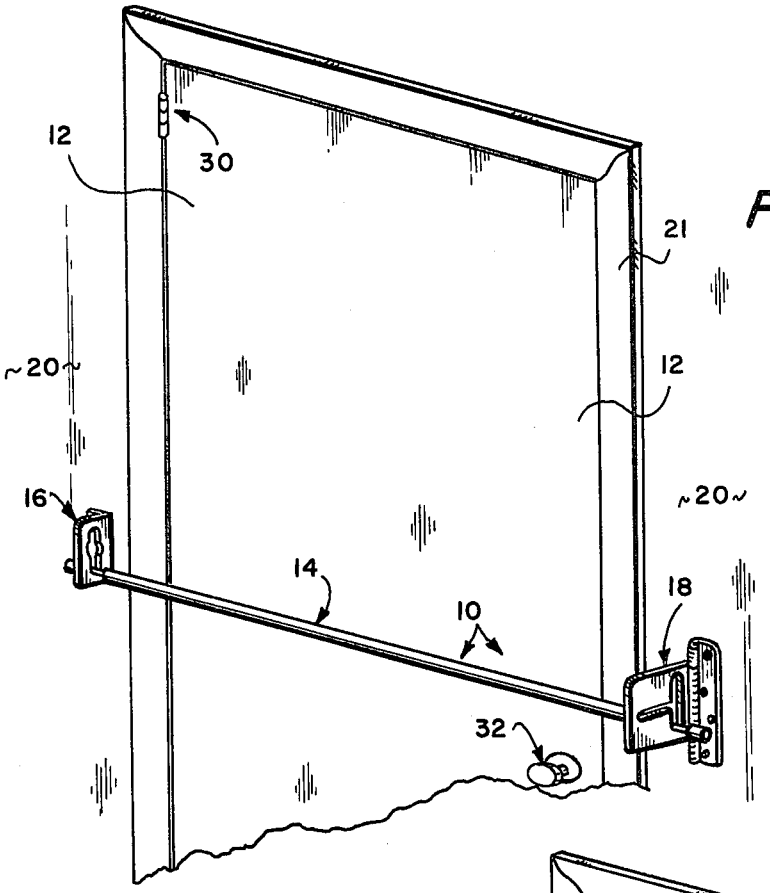
FIG. 1 is a perspective view of the invention shown mounted across a conventional door mounted within a suitable frame defined within a typical wall, with the door shown in a closed position, and with parts thereof broken away for brevity.
Figure 2:
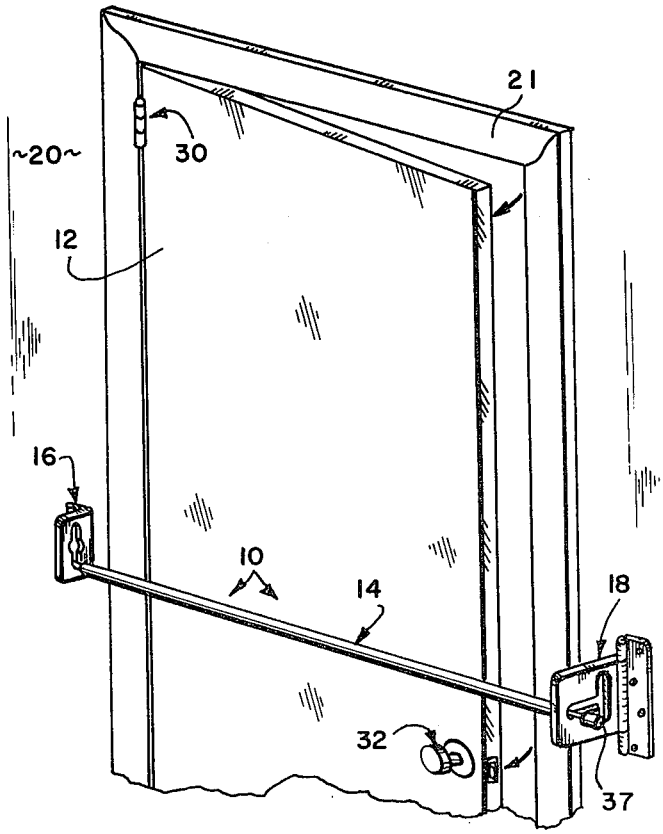
FIG. 2 is a view similar to FIG. 1, but illustrating the door in a partially opened position.

Turning now initially to FIGS. 1 and 2, a door bar security system constructed in accordance with the teachings of this invention has generally been designated by the reference numeral 10. System 10 is adapted to prevent the unauthorized opening of a door 12. To this effect the system 10 includes an elongated door bar, a first mounting bracket, and a displacement bracket, generally designated by the reference numerals 14, 16, and 18 respectively. Brackets 16, 18 are adapted to be rigidly affixed through wall 20 on opposite sides of the door 12. In other words, it is contemplated that bracket 16, 18 will be screwed in to suitable interior studs or joists (not shown) interiorly adjacent door frame molding 21. In FIGS. 1 and 2 door 12 is mounted with hinges 30 in a "left sided" configuration, wherein the door is opened from the right with a typical door knob or latch, generally designated by the reference numeral 32. As will become apparent hereinafter, the door bar system 10 is equally adapted for installation in "right sided" applications in which the hinges 30 are mounted on the right side of the door, for subsequent opening by a latch or door knob secured to the left of the door.

Door bar 14 (FIGS. 6, 7) preferably includes an elongated central portion 34 which terminates in opposite, rigid end flanges 36, 37. Reduced diameter segments 38, 39 separate the major portion of the length 34 of door bar 14 from end flanges 36, 37. AS will be described in more detail hereinafter, the flanges 36, 37 are adapted to be axially restrained in engagement with slots 40, or 42 in brackets 18 or 16 to secure the door bar.

Turning now to FIG. 3, the preferred displacement bracket 18 includes a rigid, generally planar mounting portion 43 equipped with a plurality of mounting orifices 44 through which suitable screws 46 may be secured for mounting. It will be apparent that wood screws, lag bolts or the like may be employed to mount portion 43 within a stud 48 (FIG. 4) to prevent forcible dislodgement of the bracket 18. The mounting portion 43 terminates at one side in formed, spaced-apart mandrels 50, 51. A cooperating, generally planar offset portion 56 of the displacement bracket 18 terminates in a formed mandrel portion 57 nominally positioned between mandrels 50 and 51, being hingeably secured thereto by an elongated pin 59 which is press fitted to secure mandrels 50, 57 and 51 in axial alignment. Thus offset portion 56 may be swung between positions illustrated generally in dashed lines in FIG. 3.

Importantly, the displacement bracket 18 includes a generally T-shaped slot 40 provided within its moveable, offset portion 56. As best viewed in FIGS. 3 and 5, the T-shaped slot 40 includes a generally horizontally oriented portion 62 which intersects a cooperating, generally vertically oriented portion 63. The intersection of these portions facilitates penetration of the T-shaped slot 40 by either of the flanges 36, 37 or door bar 14, clearance being provided when a portion 37B of a flange, for example, is cleared by penetrating a portion of horizontal slot 62. Once the flange 37 is admitted through slot 40 in this fashion, the reduced diameter portion 38 or 39 of the door bar 14 will snugly fit within the horizontal or vertical channel 62, 63. Thus the width 62B, 63B of channels 62, 63 respectively is approximately the same as the diameter of the reduced diameter segments 38 or 39 of the door bar 14. Thus, when the door is to remain in the position illustrated in FIG. 1, a reduced diameter door bar portion 38 or 39 will settle downwardly within vertical slot portion 63. At this time axial withdrawal of door bar 14 will be avoided since shoulders 38A, 39A and/or flanges 36 or 37 cannot clear slots 62 or 63. However, when it is desired to partially open the door, (as in FIG. 2) the reduced diameter bar portion 38 or 39 will slidingly move within horizontal slot portion 62.

Turning now to FIGS. 8 and 9, the first rigid bracket 16 includes a planar, integral mounting portion 70 provided with conventional, preferably counterbored orifices 72 through which conventional screws 73 (or lag bolts or the like) may penetrate, being received and anchored within a suitable stud 76. The offset side 80 of bracket 16 is provided with slot 42, previously discussed. The center 84 of slot 42 is adapted to be penetrated by either door bar flange end 36 or 37. The upper or lower portions 88, 89 of slot 42 are of sufficient width to receive reduced diameter mounting bar portions 38 or 39, while preventing axial penetration by either the flanges 36 or 37 of shoulders 38A, 39A previously discussed. Because of the symmetry employed, mounting bracket 16 may be mounted in a variety of configurations, and, in conjunction with the displacement bracket 18 previously discussed, will facilitate use of the system 10 with doors of either left sided or right sided configuration.

From the foregoing, it will be seen that this invention is one well adapted to obtain all the ends and objects herein set forth, together with other advantages which are obvious and which are inherent to the structure.

It will be understood that certain features and subcombination are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A security bar system for preventing undesired forcible opening of a hinge mounted door, the system adapted to be employed in conjunction with either left opening or right opening doors and comprising:

a first, rigid bracket adapted to be securely mounted adjacent the hinge side of said door; said first bracket provided with a central orifice and a generally vertically oriented slot symmetrical about said orifice;

a rigid displacement bracket adapted to be rigidly mounted adjacent the opposite side of said door, said displacement bracket comprising:

a generally planar mounting portion adapted to be rigidly secured to a wall adjacent said door; and, a cooperating, generally planar offset rigid member hingeably coupled to said mounting portion, said cooperating portion provided with a generally T-shaped, symmetrical slot including a vertically oriented slot portion and a horizontally oriented slot portion perpendicularly bisecting and communicating with said vertically oriented slot portion;

an elongated, symmetrical, reversible, rigid, generally cylindrical bar adapted to extend between said first rigid bracket and said displacement bracket and to be removeably coupled thereto whereby to secure said door, said bar terminating at each of its ends in integral, circular flange members separated from the major length of said bar by reduced diameter segments of predetermined, equal length;

said first rigid bracket central orifice being of sufficient diameter to admit either of said bar flanges, and the major length of said first slot bracket being of a width substantially equal to the diameter of said bar reduced diameter segments to prevent axial displacement of a bar flange while permitting clearance of the door bar reduced diameter segment; and, the intersection of said vertically oriented slot portion of said displacement bracket member with said horizontally oriented slot portion permitting axial admission of an opposite one of said bar end flanges, but the width of said horizontal and vertical slot portions being substantially equal to the diameter of said bar reduced diameter segments whereby to prevent axial withdrawal of said door bar flange while permitting clearance of a door bar reduced diameter segment, the generally horizontally oriented portion of said slot permitting limited opening of said door as a portion of a reduced diameter segment of said door bar may track therewithin during limited opening of said door.

* * * * *